US009392861B2

(12) United States Patent
Maybin

(10) Patent No.: US 9,392,861 B2
(45) Date of Patent: Jul. 19, 2016

(54) KAYAK BACKPACK

(71) Applicant: Landon Chandler Maybin, Zirconia, NC (US)

(72) Inventor: Landon Chandler Maybin, Zirconia, NC (US)

( * ) Notice: Subject to any disclaimer, the term of this patent is extended or adjusted under 35 U.S.C. 154(b) by 0 days.

(21) Appl. No.: 14/701,838

(22) Filed: May 1, 2015

(65) Prior Publication Data

US 2015/0230591 A1 Aug. 20, 2015

Related U.S. Application Data

(60) Provisional application No. 62/020,110, filed on Jul. 2, 2014.

(51) Int. Cl.

| | |
|---|---|
| ***A45F 4/10*** | (2006.01) |
| ***B63B 35/71*** | (2006.01) |
| ***B63B 3/08*** | (2006.01) |

(52) U.S. Cl.

CPC ... *A45F 4/10* (2013.01); *B63B 3/08* (2013.01); *B63B 35/71* (2013.01); *B63B 2035/715* (2013.01)

(58) Field of Classification Search

CPC ..... A45F 4/10; B63B 35/71; B63B 3/08; B63B 2035/715; B63B 2007/006; B63B 7/04

USPC ..... 114/347, 354, 345, 352; 224/576, 577

See application file for complete search history.

(56) References Cited

U.S. PATENT DOCUMENTS

| | | | | |
|---|---|---|---|---|
| 4,274,170 | A | 6/1981 | Simpson | |
| 4,310,273 | A * | 1/1982 | Kirrish | F16B 5/0233 411/338 |
| 4,892,054 | A * | 1/1990 | Davidson | B29C 70/66 114/355 |
| 6,371,042 | B1 | 4/2002 | Abernethy | |
| 7,854,211 | B2 | 12/2010 | Rixford | |
| 8,316,788 | B2 | 11/2012 | Willis | |
| 2010/0058971 | A1 * | 3/2010 | Rixford | B63B 7/04 114/352 |
| 2013/0200115 | A1 * | 8/2013 | Huber | B63B 7/08 224/153 |

* cited by examiner

*Primary Examiner* — Corey Skurdal

(74) *Attorney, Agent, or Firm* — Daniel Boudwin; Global Intellectual Property Agency LLC

(57) ABSTRACT

A kayak that collapses to form a backpack structure is provided. The kayak includes a plurality of removably connectable hull members. The hull members include at least a middle section, a front section, and a rear section. The middle section comprises a tapered complex body having a cavity. The tapered complex body has a width larger than width of the front section and rear section such that the tapered complex body can receive the front section and the rear section in the cavity of the middle section. A plurality of bolts are configured to removably connect the hull members. The bolts provide pressure to a rubber gasket for connecting the front section and the rear section to the middle section. A cockpit is formed by removably connecting the front section and rear section to the middle section via the bolts. A seat member is removably attached to the cockpit.

12 Claims, 3 Drawing Sheets

KAYAK BACKPACK

CROSS REFERENCE TO RELATED APPLICATION

This application claims the benefit of U.S. Provisional Application No. 62/020,110 filed on Jul. 2, 2014. The above identified patent application is herein incorporated by reference in its entirety to provide continuity of disclosure.

FIELD OF THE INVENTION

The invention generally relates to a collapsible kayak. More specifically, the present invention relates to a kayak structure that disassembles to form a backpack frame for transport by a user.

BACKGROUND OF THE INVENTION

Collapsible kayaks having several designs have been commercially available for many years. Some of the better known types are assembled from a plurality of disconnected stringers and formers which are joined together with latches and clamps to form a relatively loose framework, in which the bow and stern halves are temporarily hinged together. A skin or liner is stretched over the framework having bow and stern-shaped pockets and a central upper opening adjacent the cockpit structure. The opening receives the two halves of the framework, sometimes separately, which halves are then rigidly connected together inside the skin. In some designs an over-centering means or an equivalent stretches the skin to form a relatively taut skin around the framework. Commonly the skin is strained somewhat to provide a reaction to force on the framework and thus is an integral structural part of the kayak, that is, without the skin the kayak frame has insufficient rigidity.

Such designs, when disassembled, result in a large number of disconnected pieces and require a considerable time to re-assemble, and require skill and care in following the instructions. It is not unusual to accidently lose an important piece when the kayak is disassembled. If the kayak is to be transported in its collapsed state at least two bags are required, one of the bags containing the stringers, formers, fasteners, etc. of the framework, and the other bag containing the skin. Whilst such a kayak has the advantage of being collapsible for fitting in a confined space, these structures are usually not designed primarily for easy carrying on a person's back.

Due to these difficulties, there is a significant demand for a watercraft that can be collapsed into small packages for storage or transport. The simplest of these are inflatable boats, which use a system of air-filled pneumatic tubes to provide form, structure and flotation. While such watercraft are compact and inexpensive, they are typically slow and hard to maneuver, due to shape limitations imposed by pneumatic systems. Thus, there is a need for a kayak that is more easily transportable than a traditional rigid-bodied kayak, yet more durable and reliable than an inflatable kayak.

SUMMARY OF THE INVENTION

In view of the foregoing disadvantages inherent in the known types of portable watercrafts now present in the prior art, the present invention provides a kayak structure that disassembles to a backpack frame wherein the same can be utilized for providing convenience for the user when transporting a kayak.

It is therefore an object of the present invention to provide new and improved collapsible kayak that has all of the advantages of the prior art and none of the disadvantages.

It is another object of the present invention to provide a kayak that collapses to form a backpack structure. The kayak includes a plurality of removably connectable hull members. The hull members include at least a middle section, a front section, and a rear section. The middle section may comprise a tapered complex body having a cavity. The tapered complex body of the middle section has a width larger than the width of the front section and the rear section such that the tapered complex body can receive the front section and the rear section in the cavity of the tapered complex body.

It is yet another object of the present invention to provide a plurality of bolts that are configured to removably connect the hull members. The bolts provide pressure to a rubber gasket for connecting the front section and the rear section to the middle section. A cockpit is formed by removably connecting the front section and the rear section to the middle section via the bolts. A seat member is removably attached to the cockpit.

It is one object of the present invention to provide a collapsible kayak wherein the middle section has a larger width than the rear section such that the tapered complex body of the middle section can receive the rear section in a cavity of the tapered complex body. The rear section and the front section comprise tapered complex bodies. The front section has a width larger than the rear section such that the tapered complex body of the front section can receive the rear section in a cavity of the tapered complex body.

It is another object of the present invention to have a kayak with a cavity in the middle section configured to receive the front section and the rear section. The middle section comprises a tapered complex body having a base and two opposing side walls. The front section and rear section are narrower than the middle section such that the front section and rear section can slide into the tapered complex body of the middle section.

Another aspect of the present invention is a seat member that is removably attached to the base of the middle section. The seat member comprises a plurality of straps disposed on the seat member. The plurality of straps disposed on the seat member are adapted to surround the middle section forming a backpack frame. At least two straps are disposed on a front portion of the seat member. The at least two straps are removably secured to a user.

It is another aspect of the present invention to provide a middle section that includes female bands at opposing ends of the tapered complex body. The front section and the rear section include a male band. The male band is configured to slide along an inner surface of the female band. The bolts are threaded through the male band and female band to compress the rubber gasket between the male band and the female band to provide a watertight seal.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
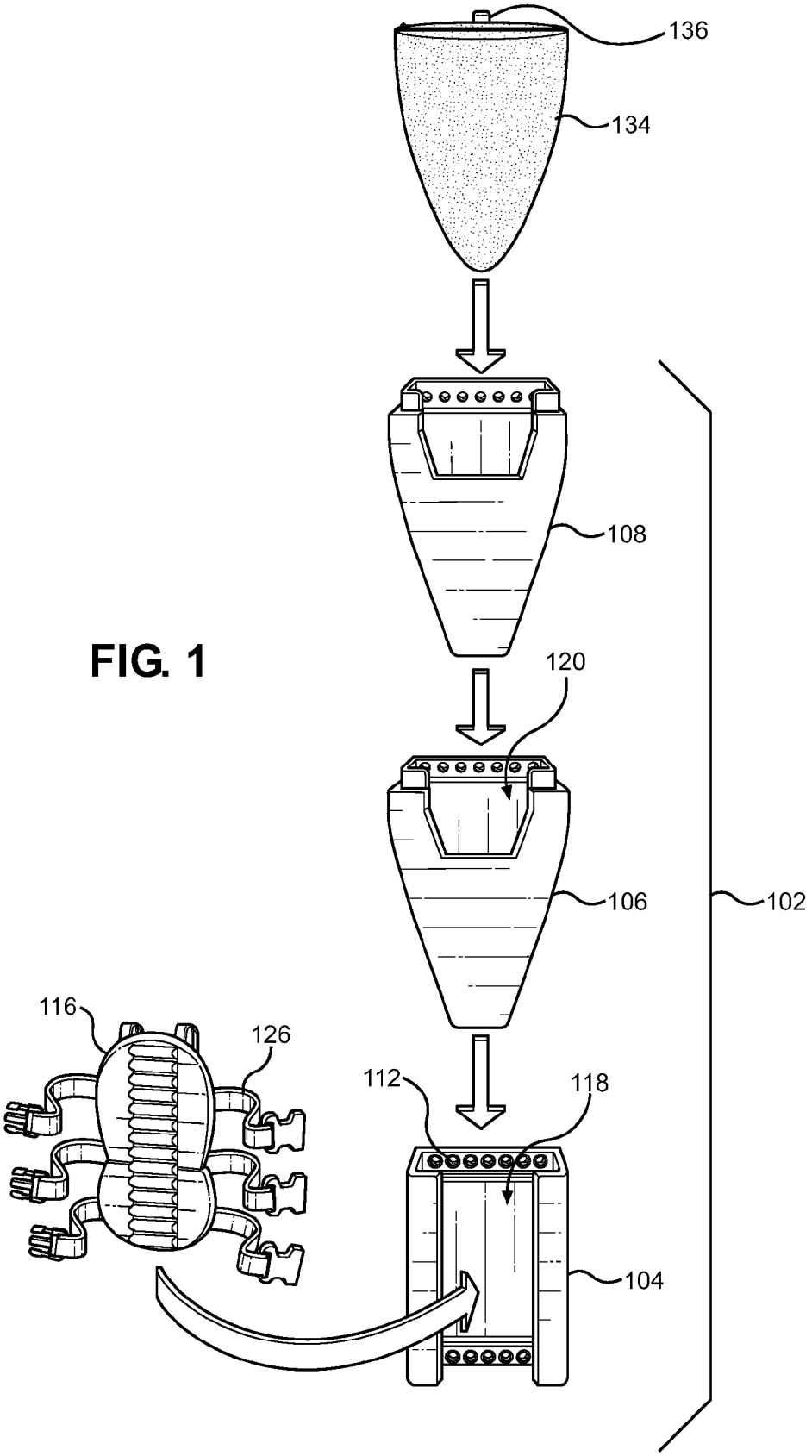
FIG. 1 shows a kayak disassembled to form a backpack according to one embodiment of the present invention.

Reference is made herein to the attached drawings. Like reference numerals are used throughout the drawings to depict like or similar elements of the kayak backpack. For the purposes of presenting a brief and clear description of the present invention, the preferred embodiment will be discussed as used for collapsing the kayak to form a backpack frame. The figures are intended for representative purposes only and should not be considered to be limiting in any respect.

Referring now to FIG. 1, there is shown a kayak disassembled to form a backpack according to one embodiment of the present invention. The kayak includes hull members 102 that collapse to form a backpack frame. A plurality of removably connectable hull members 102 comprise the kayak body. The hull members 102 may comprise a hard shell material. In a preferred embodiment, the hull members 102 comprise an aluminum sub-frame sandwiched between layers of fiberglass.

The hull members 102 include at least a middle section 104, a front section 106, and a rear section 108. The middle section 104 comprises a tapered complex body having a cavity 118. The tapered complex body of the middle section 104 has a width larger than width of the front section 106 and the rear section 108 such that the tapered complex body can receive the front section 106 and the rear section 108 in the cavity 118 of the tapered complex body. The rear section 108 and front section 106 are stacked within the middle section 104.

The middle section 104 has a larger width than the rear section 108, and the front section 106 has a larger width than the rear section 108. The middle section 104 is configured to receive the front section 106, and the front section 106 is configured to receive the rear section 108 in a stacked arrangement within the middle section 104. A soft shell 134 may be placed within the cavity of the rear section 108. In a preferred embodiment, the soft shell 134 is a cloth pack that serve as a liner in the interior of the kayak 100.

The middle section 104 includes a base and a pair of upstanding sidewalls that serve as the sides of the kayak 100. The front end and rear end of the middle member are open so as to receive the front section 106 and rear section 108. The front section 106 and rear section 108 comprises a base and sidewalls, a closed end and an open end. The front section 106 and rear section 108 are roughly triangular in configuration. A flange extends outward from the open end of the front section 106 and the rear section 108 and is adapted to engage with the middle section 104. The front section 106 and rear section 108 are secured to the middle section 104 with fasteners.

The soft shell 134 is designed so that it can be removed from the other hull members 102 and carried separately, or be used in conjunction with the other parts. The soft shell 134 may be a waterproof bag that fits snugly down inside the rear section 108 of the kayak 100, but small enough so that it does not stick out of the end. The soft shell 134 may have a handle 136 on the top so that it can be easily removed from the hull members 102, and a padded strap so that it can be easily carried.

The front section 106 and the rear section 108 comprise tapered complex bodies. The tapered complex body of the front section 106 has a width larger than the rear section 108 such that the front section 106 can receive the rear section 108 in a cavity 120 of the tapered complex body. The front section 106 and the rear section 108 are narrower than the middle section 104 such that the front section 106 and the rear section 108 can slide into the tapered complex body of the middle section 104. A seat member 116 is removably attached to the middle section 104. The seat member 116 includes a plurality of straps 126 disposed on the seat member 116.

Figure 2:
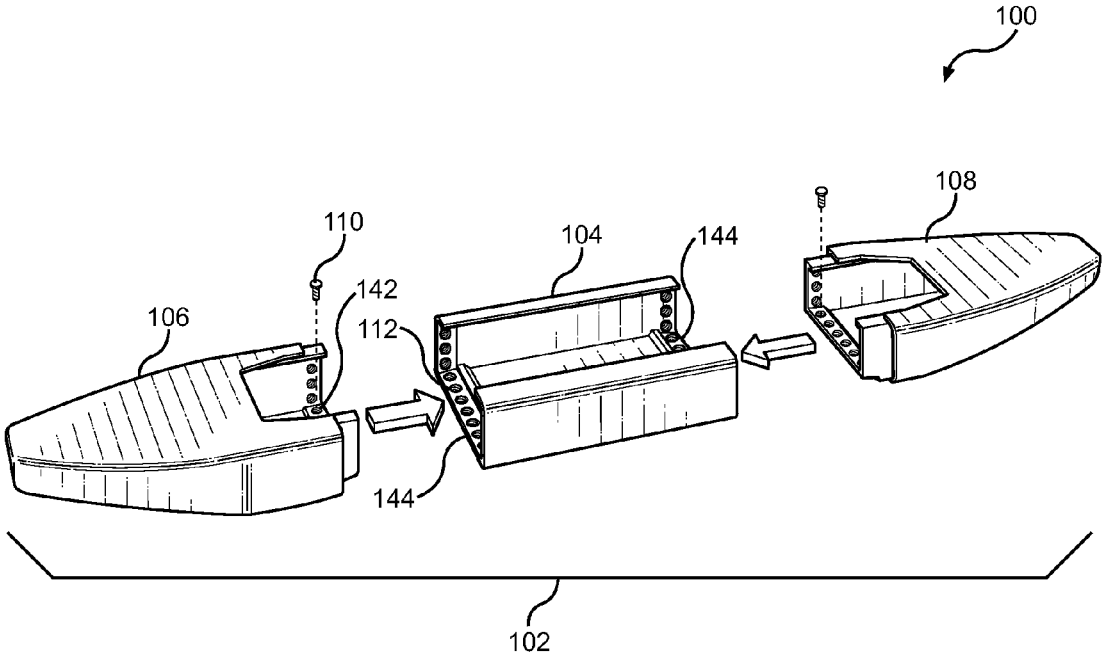
FIG. 2 shows a plurality of hull members of the kayak according to one embodiment of the present invention.

Referring now to FIG. 2, there is shown a plurality of hull members 102 of the kayak 100 according to one embodiment of the present invention. The hull members 102 can be removably connected to form the kayak 100. The hull members 102 include at least a middle section 104, a front section 106, and a rear section 108. It is contemplated that the hull members 102 may comprise of at least three sections that are removably connected to form the kayak 100.

A plurality of bolts 110 are inserted into the connection regions of the hull members 102. The middle section 108 has female bands located at the opposing open portions of the middle section. A male band is located on the open portions of the front section 106 and the rear section 108. The bolts 110 are inserted into the aligning apertures of the male and female bands to removably connect the hull members 102. The bolts 110 provide pressure to a rubber gasket 112 to connect the front section 106 and the rear section 108 to the middle section 104. The bolts 110 and rubber gasket 112 provide a water tight seal for the kayak body.

According to another embodiment of the present invention, the body of the kayak 100 is made of three hull members 102, which include middle section 104, a front section 106, and a rear section 108. These three sections each have an aluminum subframe. The subframes connect to each other to create a watertight seal by using bolts 110 to compress a rubber gasket 112 between a male band 142 and a female band 144 located along the edge of the kayak. The middle section 104 has female bands 144 at opposing ends of the tapered complex body. The front section 106 and the rear section 108 include a male band 142. The male band 142 is configured to slide along an inner surface of the female band 144. The bolts 110 are threaded through the male band 142 and female band 144 to compress the rubber gasket 112 between the male band 142 and the female band 144 to provide a watertight seal.

Figure 3:
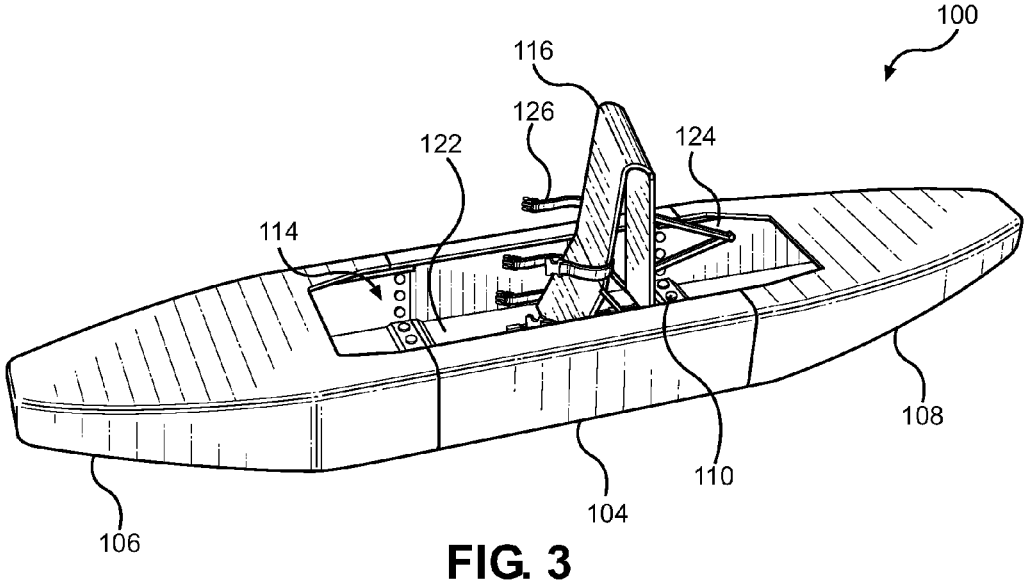
FIG. 3 shows the collapsible kayak according to one embodiment of the present invention.

Referring now to FIG. 3, there is shown the collapsible kayak 100 according to one embodiment of the present invention. The middle section 104 comprises a tapered complex body having a base 122 and two opposing side walls 124. A cockpit 114 is formed by removably connecting the front section 106 and rear section 108 to the middle section 104 via the bolts 110. A seat member 116 is removably attached to the cockpit 114. The seat member 116 is removably attached to the base 122 of the middle section 104. The seat member 116 includes a plurality of straps 126 disposed on the seat member 116 that secure a user to the kayak.

According to another example embodiment of the present invention, the kayak is disassembled by disconnecting the bolts 110 connecting the hull members 102 and removing the seat member 116 and soft shell. The front section 106 is inserted into the middle section 104, then the rear section 108 is slid into the hollow interior of the front section 106. A plurality of straps 116 that are connected to the seat member 116 that allow the device to be carried in a backpack form. A soft shell can slide inside the rear section 108 of the kayak 100. The device provides a hard-shelled kayak device that allows the user to sit therein and is highly stable in water.

The hull members of the kayak 100 can be made of an aluminum subframe sandwiched between layers of fiberglass, plastic molding, or a polymer. The subframe is not visible except for the male and female bands used to seal the kayak 100 body. The male and female bands used to seal the kayak together are covered with a waterproofing agent, such as polyurethane, to keep corrosion and rust from lessening the seals integrity.

Figure 4:
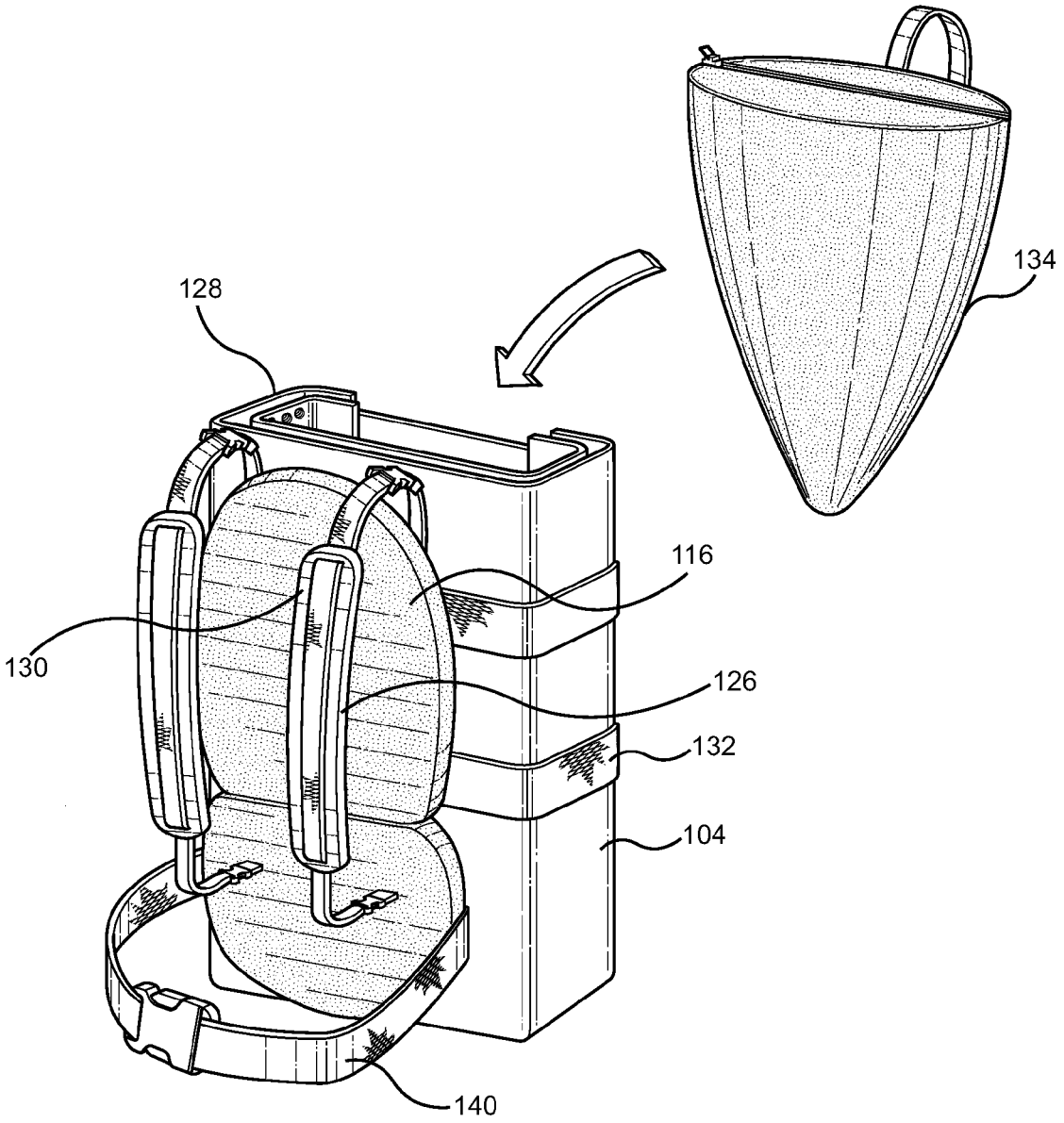
FIG. 4 shows the collapsed kayak in the backpack frame according to one embodiment of the present invention.

Referring now to FIG. 4, there is shown the collapsed kayak in the backpack frame according to one embodiment of the present invention. A plurality of straps 126 are disposed on the seat member 116 are adapted to surround the middle section 104 forming a backpack frame 128. At least two straps 130 are disposed on a front portion of the seat member 116. The at least two straps 130 are removably secured to a user.

The seat member 116 serves a dual purpose. As a kayak, the seat member 116 functions as a seat, however, when the kayak 100 is disassembled and the hull members are stacked inside each other, the seat member 116 functions as a backpack frame 128. The seat member 116 has straps 126 that allow the disassembled kayak 100 to be carried like a backpack. On the back side of the backrest portion of the seat member 116 there are straps 126 and a belt 140 to allow the seat member 116 to support the kayak 100 while it is on a person's back.

In one example embodiment, there are two adjustable straps 126 disposed on both sides along the edges of the backrest portion. When the seat member 116 is being used as a seat, the lower straps 132 use a bolt to secure the seat member 116 to either side of the cockpit on the base of the middle section 104 of the kayak 100. The lower part of the seat member 116 has a strap coming out of the middle of the lower edge, this strap uses a bolt to connect to the front seal. When the seat member 116 is being used as a backpack, the three sections are stacked inside each other and placed in the seat. The lower strap 132 then comes over the body sections and connects back to the top of the seat member 116. The other straps then wrap around the body sections and secure to the lower strap 132 using the same bolts that it connected to the kayak.

This system also allows for different sections to be interchangeable as long as the gasket system is the same. This allows the kayak to adapt for every trip. These different sections can have many different features, such as a thinner hull for weight reduction, or a thicker hull for increased durability, different subframes, different lengths to make the kayak longer or shorter, different center of balance, and different hull and deck shapes to make the kayak react differently in the water. The original hull members are designed to stack inside each other, and even though the other pieces may also stack within the hull members, it is contemplated that they may sacrifice this quality to achieve a different purpose. The bands seal together the hull members using bolts and a rubber gasket, which also allows for attachments to be easily added to the inside of the kayak such as foot braces, a water bottle holder, or a net to secure small items.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A kayak collapsible to form a backpack structure, comprising:

a plurality of removably connectable hull members, wherein the hull members include at least a middle section, a front section, and a rear section;

a plurality of bolts configured to removably connect the plurality of removably connectable hull members, the bolts compress a rubber gasket to provide a watertight seal for the hull members;

a cockpit formed by removably connecting the front section and the rear section to opposing ends of the middle section via the bolts;

a seat member removably attached to the cockpit;

wherein the middle section comprises a tapered complex body having a cavity, the tapered complex body having a width larger than the width of the front section and the rear section such that the tapered complex body can receive the front section and the rear section in the cavity of the middle section;

wherein the middle section includes female bands at opposing ends of the tapered complex body;

wherein the front section and the rear section include a male band at a portion of the front section and the rear section, the male band configured to slide along an inner surface of the female band.

2. The collapsible kayak of claim 1, wherein the front section comprises a substantially tapered complex body, the tapered complex body having a width larger than that of the rear section such that the front section can receive the rear section therein.

3. The collapsible kayak of claim 1, wherein the rear section comprises a substantially tapered complex body, wherein the front section has a width greater than that of the rear section.

4. The collapsible kayak of claim 1, wherein the cavity in the middle section is configured to receive the front section and the rear section.

5. The collapsible kayak of claim 1, wherein the middle section comprises a base and two opposing side walls.

6. The collapsible kayak of claim 5, wherein the seat member is removably attached to the base of the middle section.

7. The collapsible kayak of claim 1, wherein the plurality of hull members comprise an aluminum subframe sandwiched between layers of fiberglass.

8. The collapsible kayak of claim 1, wherein the seat member includes a plurality of straps disposed thereon.

9. The collapsible kayak of claim 8, wherein the plurality of straps disposed on the seat member are adapted to surround the middle section forming a backpack frame.

10. The collapsible kayak of claim 8, wherein at least two straps are disposed on a front portion of the seat member, wherein the at least two straps are removably secured to a user.

11. The collapsible kayak of claim 1, wherein the bolts are threaded through a plurality of apertures of the male band and the female band to compress the rubber gasket between the male band and the female band to provide a watertight seal.

12. The collapsible kayak of claim 1, further comprising a soft shell, wherein the soft shell is a cloth pack that fits in the rear section.

* * * * *